US008253677B2

(12) United States Patent
Choi et al.

(10) Patent No.: US 8,253,677 B2
(45) Date of Patent: Aug. 28, 2012

(54) DISPLAY DEVICE AND METHOD OF DRIVING THE SAME

(75) Inventors: Yun-Seok Choi, Asan-si (KR); Se-Hoon Lee, Asan-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 542 days.

(21) Appl. No.: 12/468,442

(22) Filed: May 19, 2009

(65) Prior Publication Data

US 2010/0053147 A1 Mar. 4, 2010

(30) Foreign Application Priority Data

Aug. 26, 2008 (KR) ..... 10-2008-0083403

(51) Int. Cl.
*G09G 3/36* (2006.01)

(52) U.S. Cl. ..... 345/96; 345/87; 345/89; 345/690

(58) Field of Classification Search ..... 345/87, 345/89, 214, 596, 96, 690
See application file for complete search history.

(56) References Cited

U.S. PATENT DOCUMENTS 7,889,166 B2 * 2/2011 Moon ..... 345/89
2004/0130559 A1 * 7/2004 Lee et al. ..... 345/690
2005/0162369 A1 * 7/2005 Kim et al. ..... 345/98
2005/0219176 A1 * 10/2005 Song ..... 345/87
2007/0070018 A1 * 3/2007 Moon ..... 345/98
2007/0120794 A1 * 5/2007 Shin et al. ..... 345/89
2008/0158269 A1 * 7/2008 Wang et al. ..... 345/698
2008/0180378 A1 * 7/2008 Tang ..... 345/96
2008/0224976 A1 * 9/2008 Lee et al. ..... 345/89
2009/0073185 A1 * 3/2009 Liao ..... 345/596

* cited by examiner

*Primary Examiner* — Amare Mengistu
*Assistant Examiner* — Koosha Sharifi-Tafreshi
(74) *Attorney, Agent, or Firm* — F. Chau & Associates, LLC

(57) ABSTRACT

Provided are a display device with improved display quality and a method of driving the same. The display device includes: a display panel which includes a plurality of dither blocks displaying an image that corresponds to a dither image signal; and an image signal controller which generates the dither image signal by using a dither pattern that determines a plurality of dither pixels, which are to be dithered, from among a plurality of pixels included in each of the dither blocks, wherein each of the dither blocks includes a plurality of pixels, whose respective polarities are inverted every frame and which are driven accordingly, and comprises equal numbers of positive-polarity dither pixels and negative-polarity dither pixels.

17 Claims, 10 Drawing Sheets

FIG. 5

| DITHER LEVEL | LSB 3bit | FRAME | | | | | | | |
|---|---|---|---|---|---|---|---|---|---|
| | | 8n | 8n+1 | 8n+2 | 8n+3 | 8n+4 | 8n+5 | 8n+6 | 8n+7 |
| 0/8 | 000 | < FIRST DITHER PATTERNS > | | | | | | | |
| 1/8 | 001 | < SECOND DITHER PATTERNS > | | | | | | | |
| 2/8 | 010 | < THIRD DITHER PATTERNS > | | | | | | | |
| 3/8 | 011 | < FOURTH DITHER PATTERNS > | | | | | | | |
| 4/8 | 100 | < FIFTH DITHER PATTERNS > | | | | | | | |
| 5/8 | 101 | < SIXTH DITHER PATTERNS > | | | | | | | |
| 6/8 | 110 | < SEVENTH DITHER PATTERNS > | | | | | | | |
| 7/8 | 111 | < EIGHTH DITHER PATTERNS > | | | | | | | |

| DITHER LEVEL | 4/8 | 5/8 | 6/8 | 7/8 |
|---|---|---|---|---|
| COMBINED MATRIX | $\begin{pmatrix} 0 & 0 & 0 & 0 \\ 0 & 0 & 0 & 0 \\ 0 & 0 & 0 & 0 \\ 0 & 0 & 0 & 0 \end{pmatrix}$ | $\begin{pmatrix} 0 & 2 & -2 & 0 \\ -2 & 0 & 0 & 2 \\ 2 & 0 & 0 & -2 \\ 0 & -2 & 2 & 0 \end{pmatrix}$ | $\begin{pmatrix} 1 & -1 & -1 & 1 \\ -1 & 1 & -1 & 1 \\ -1 & 1 & 1 & -1 \\ 1 & -1 & 1 & -1 \end{pmatrix}$ | $\begin{pmatrix} -1 & 1 & -1 & 1 \\ 1 & -1 & 1 & -1 \\ -1 & 1 & -1 & 1 \\ 1 & -1 & 1 & -1 \end{pmatrix}$ |
| ROW-POLARITY SUM AND COLUMN-POLARITY SUM OF COMBINED MATRIX |   |   |   |   |
| Sum (ROW-POLARITY SUM) | 0 | 0 | 0 | 0 |
| Sum (COLUMN-POLARITY SUM) | 0 | 0 | 0 | 0 |

DISPLAY DEVICE AND METHOD OF DRIVING THE SAME

This application claims priority from Korean Patent Application No. 10-2008-0083403 filed on Aug. 26, 2008 in the Korean Intellectual Property Office, the contents of which are herein incorporated by reference in their entirety.

BACKGROUND OF THE INVENTION

1. Field of the Invention

The present disclosure is directed to a display device and a method of driving the same, and more particularly, to a display device with improved display quality and a method of driving the same.

2. Description of the Related Art

A display device typically includes a display panel and a panel driver. The display panel may include a first display panel having pixel electrodes, a second display panel having a common electrode, and dielectrically anisotropic liquid crystal molecules interposed between the first and second display panels. The panel driver may include a gate driver which transmits gate signals to a plurality of gate lines, a data driver which outputs image data voltages to a plurality of data lines, and a signal controller which outputs signals for controlling the operations of the gate driver and the data driver.

In order to improve display quality of the display device, the signal controller may apply dither patterns to an image signal received from an external source and output a dither image signal. Dither is an intentionally applied form of noise, used to randomize quantization error in digital signals, that prevents large-scale patterns such as contouring that are more objectionable than uncorrelated noise. Here, a dither pattern determines dither pixels, which are to be dithered, from among a plurality of pixels included in each dither block. Through the dithering process, an image having multiple gray levels can be expressed. However, the dithering process may cause horizontal or vertical lines to be seen on the display device or cause flickering, thereby deteriorating display quality of the display device.

SUMMARY OF THE INVENTION

Embodiments of the present invention provide a display device with improved display quality.

Embodiments of the present invention also provide a method of driving a display device with improved display quality.

According to an aspect of the present invention, there is provided a display device including: a display panel which includes a plurality of dither blocks displaying an image that corresponds to a dither image signal; and an image signal controller which generates the dither image signal by using a dither pattern that determines a plurality of dither pixels, which are to be dithered, from among a plurality of pixels included in each of the dither blocks, wherein each of the dither blocks includes a plurality of pixels, whose respective polarities are inverted every frame and which are driven accordingly, and includes equal numbers of positive-polarity dither pixels and negative-polarity dither pixels.

According to another aspect of the present invention, there is provided a method of driving a display device. The method includes: assigning a dither pattern which determines a plurality of dither pixels, which are to be dithered, from among a plurality of pixels included in each dither block; generating a dither image signal by applying the dither pattern to an original image signal; and displaying an image corresponding to the dither image signal, wherein the dither pattern is assigned such that each dither block includes equal numbers of positive-polarity dither pixels and negative-polarity dither pixels.

BRIEF DESCRIPTION OF THE DRAWINGS

FIG. 5 is a table showing a dither set for each dither level.

DETAILED DESCRIPTION OF EXEMPLARY EMBODIMENTS

Figure 1:
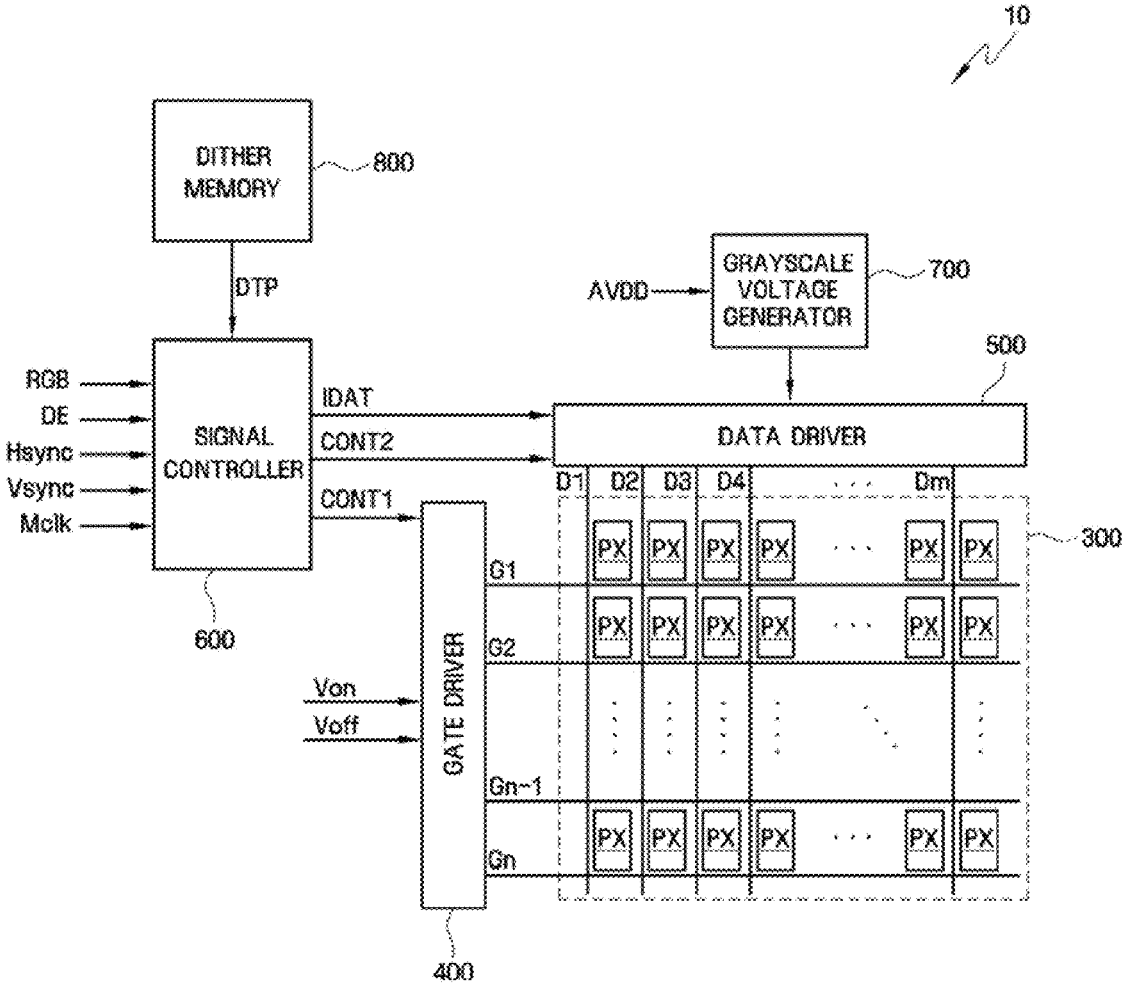
FIG. 1 is a block diagram for explaining a display device and a method of driving the same according to an exemplary embodiment of the present invention.

Exemplary embodiments of the present invention and methods of accomplishing the same may be understood more readily by reference to the following detailed description and the accompanying drawings. The present invention may, however, be embodied in many different forms and should not be construed as being limited to the embodiments set forth herein. Like reference numerals refer to like elements throughout the specification.

Figure 2:
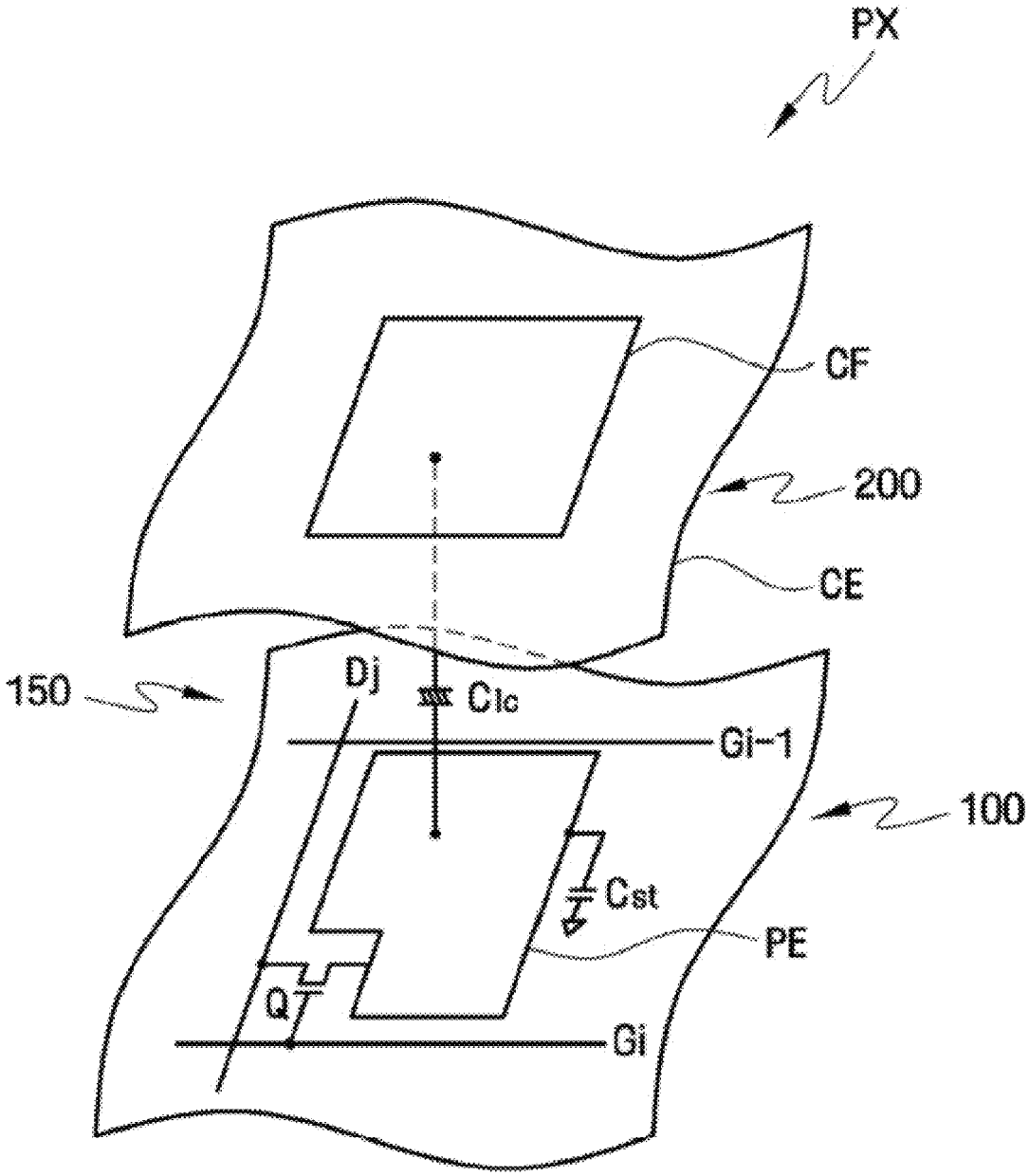
FIG. 2 is an equivalent circuit diagram of a pixel included in a display panel shown in FIG. 1.

FIG. 1 is a block diagram of a display device 10 and a method of driving the same according to an exemplary embodiment of the present invention. FIG. 2 is an equivalent circuit diagram of a pixel PX included in a display panel 300 shown in FIG. 1.

Referring to FIG. 1, the display device 10 may include the display panel 300, a signal controller 600, a dither memory 800, a gate driver 400, a data driver 500, and a grayscale voltage generator 700.

The display panel 300 includes a plurality of gate lines G1 through Gn, a plurality of data lines D1 through Dm, and a plurality of pixels PX. The gate lines G1 through Gn extend in a substantially row direction and are substantially parallel to each other, and the data lines D1 through Dm extend in a substantially column direction and are substantially parallel to each other. The pixels PX are defined in regions in which the gate lines G1 through Gn cross the data lines D1 through Dm, respectively. The gate driver 400 transmits a plurality of gate signals to the gate lines G1 through Gn, and the data driver 500 transmits a plurality of image data voltages to the data lines D1 through Dm. The pixels PX display images in response to the image data voltages, respectively.

As will be described later, the signal controller 600 may output a dither image signal IDAT to the data driver 500, and the data driver 500 may output an image data voltage corresponding to the dither image signal IDAT. Since each of the pixels PX included in the display panel 300 displays an image element in response to a corresponding image data voltage, it may ultimately display an image element corresponding to the dither image signal IDAT.

The display panel 300 may include a plurality of dither blocks (not shown) which display images in response to the dither image signal IDAT. A dither pattern may be applied to each of the dither blocks included in the display panel 300. For example, each dither pattern may be applied to pixels which are arranged in a 4×4 matrix (see FIG. 5). Here, each dither block may include a plurality of pixels PX whose polarities are inverted every frame, which will be described in detail later in relation to each dither pattern.

FIG. 2 is an equivalent circuit diagram of one pixel PX. Referring to FIG. 2, the pixel PX is connected to, for example, an $i^{th}$ (i=1 to n) gate line Gi and a $j^{th}$ (j=1 to m) data line Dj. The pixel PX includes a switching device Q, which is connected to the $i^{th}$ gate line Gi and the $j^{th}$ data line Dj, and a liquid crystal capacitor Clc and a storage capacitor Cst which are connected to the switching device Qp. As shown in FIG. 2, the liquid crystal capacitor Clc may include two electrodes, for example, a pixel electrode PE of a first display panel 100 and a common electrode CE of a second display panel 200, and liquid crystal molecules 150 which are interposed between the pixel electrode PE and the common electrode CE. When the switching device Q is turned on, an image data voltage, which is applied to the $j^{th}$ data line Dj, may be applied to the pixel electrode PE. The liquid crystal capacitor Clc may be charged with the difference between a common voltage Vcom applied to the common electrode CE and the image data voltage applied to the pixel electrode PE. A color filter CF is formed on a portion of the common electrode CE.

Referring back to FIG. 1, the signal controller 600 receives an original image signal RGB and external control signals for controlling the display of the original image signal RGB and outputs the dither image signal IDAT, gate control signals CONT1, and data control signals CONT2.

Specifically, the signal controller 600 may receive the original image signal RGB and output the dither image signal IDAT. The signal controller 600 may also receive external control signals from an external source and generate the gate control signals CONT1 and the data control signals CONT2. Examples of the external control signals include a data enable signal DE, a horizontal synchronization signal Hsync, a vertical synchronization signal Vsync, and a main clock signal Mclk. The gate control signals CONT1 are used to control the operation of the gate driver 400, and the data control signals CONT2 are used to control the operation of the data driver 500. The signal controller 600 will be described in more detail later with reference to FIG. 3.

The dither memory 800 may store a series of dither patterns, in the form of a lookup table (LUT), whose entries correspond to each dither level. The signal controller 600 may read dither patterns from the dither memory 800, apply the read dither patterns to the original image signal RGB, and output the dither image signal IDAT, which will be described in more detail later with reference to FIG. 4.

The gate driver 400 receives the gate control signals CONT1 from the signal controller 600 and transmits a gate signal to each of the gate lines G1 through Gn. Here, the gate signal may include a gate-on voltage Von and a gate-off voltage Voff which are provided by a gate on/off voltage generator (not shown).

The data driver 500 receives the data control signals CONT2 from the signal controller 600 and applies an image data voltage, which corresponds to the dither image signal IDAT, to each of the data lines D1 through Dm. The image data voltage, to which the dither image signal IDAT is applied, may be provided by the grayscale voltage generator 700.

The grayscale voltage generator 700 may divide a driving voltage AVDD into a plurality of image data voltages based on the gray level of the dither image signal IDAT and provide the image data voltages to the data driver 500. The grayscale voltage generator 700 may include a plurality of resistors connected in series between a node, to which the driving voltage AVDD is applied, and a ground source. Thus, the grayscale voltage generator 700 may divide the level of the driving voltage AVDD and generate a plurality of grayscale voltages. The internal circuit of the grayscale voltage generator 700 is not limited to the above example and may be implemented in various ways.

Figure 3:
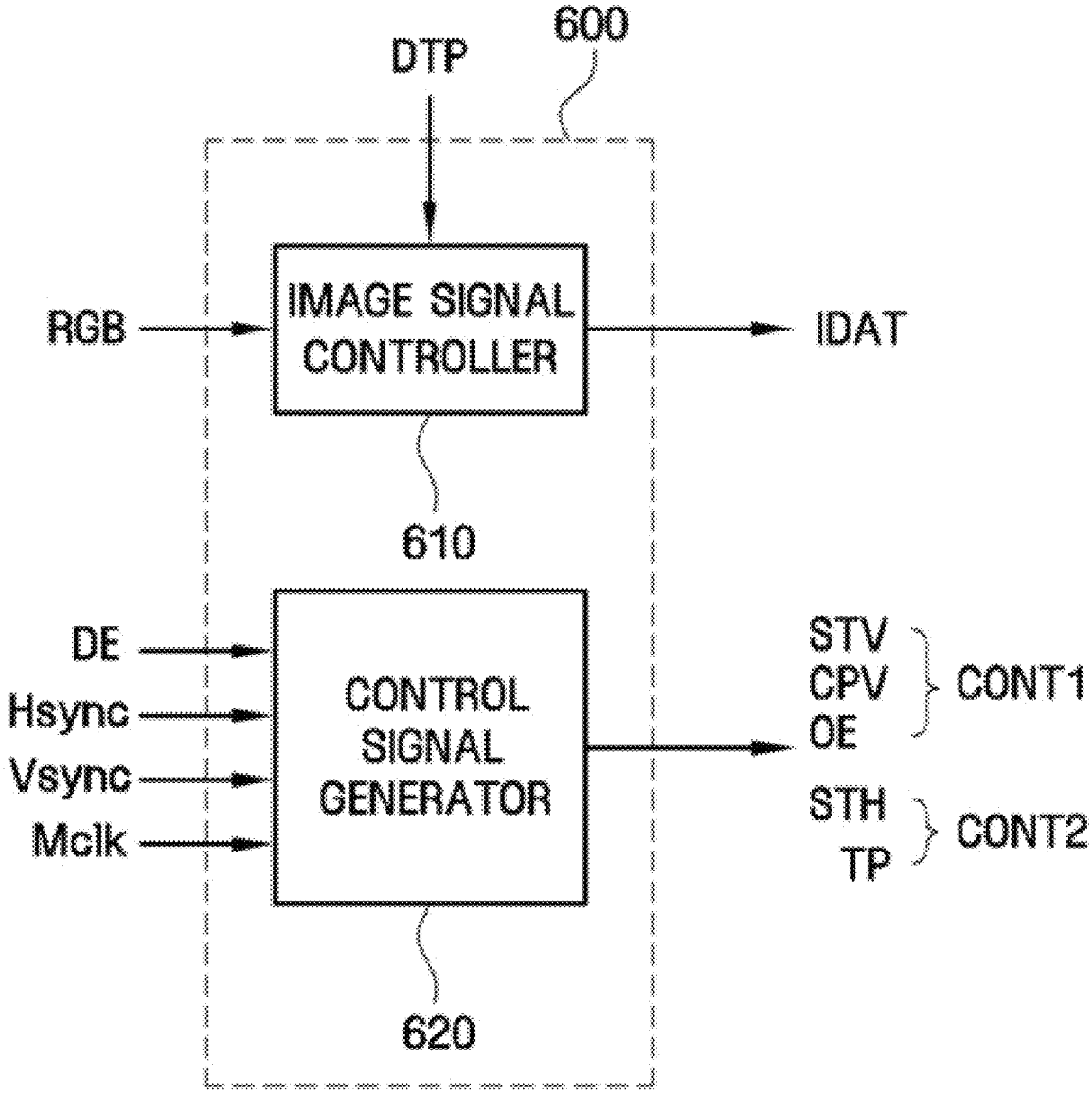
FIG. 3 is a block diagram of a signal controller shown in FIG. 1.

FIG. 3 is a block diagram of the signal controller 600 shown in FIG. 1. Referring to FIG. 3, the signal controller 600 may include an image signal controller 610 and a control signal generator 620.

The image signal controller 610 may read dither patterns DTP from the dither memory 800, generate the dither image signal IDAT by using the read dither patterns, and transmit the generated dither image signal IDAT to the data driver 500 (see FIG. 1).

The number of bits of the original image signal RGB transmitted to the image signal controller 610 may be a first number of bits, and the number of bits of the dither image signal IDAT may be a second number of bits which is less than the first number of bits. In addition, the number of bits of an image data voltage output from the grayscale voltage generator 700 (see FIG. 1) may be the second number of bits which is the number of bits of the dither image signal IDAT.

Each of the dither blocks included in the display panel 300 (see FIG. 1) displays an image corresponding to the dither image signal IDAT which is obtained by dithering the original image signal RGB. Thus, although the number of bits of the dither image signal IDAT and the number of bits of the image data voltage are less than that of the original image signal RGB, each dither block can express an image close to an image that corresponds to the original image signal RGB, which will be described in more detail later with reference to FIG. 5.

The control signal generator 620 may receive the external control signals (such as the data enable signal DE, the horizontal synchronization signal Hsync, the vertical synchronization signal Vsync, and the main clock signal Mclk) from an external source and output the gate control signals CONT1 and the data control signals CONT2. Here, the data enable signal DE is maintained high during a section, in which the original image signal RGB is input, to indicate that a signal provided by an external source, e.g., a graphic controller (not shown), is the original image signal RGB. The vertical synchronization signal Vsync indicates the start of a frame, and the horizontal synchronization signal Hsync identifies a gate line. The main clock signal Mclk is a clock signal which synchronizes all signals required to operate the display device 10.

The gate control signals CONT1 are used to control the operation of the gate driver 400. The gate control signals CONT1 may include a vertical start signal STV for starting the gate driver 400, a gate clock signal CPV for determining when to output the gate-on voltage Von, and an output enable signal OE for determining the pulse width of the gate-on voltage Von. The data control signals CONT2 are used to control the operation of the data driver 500. The data control signals CONT2 may include a horizontal start signal STH for starting the data driver 500 and an output instruction signal TP for instructing the output of an image data voltage.

Figure 4:
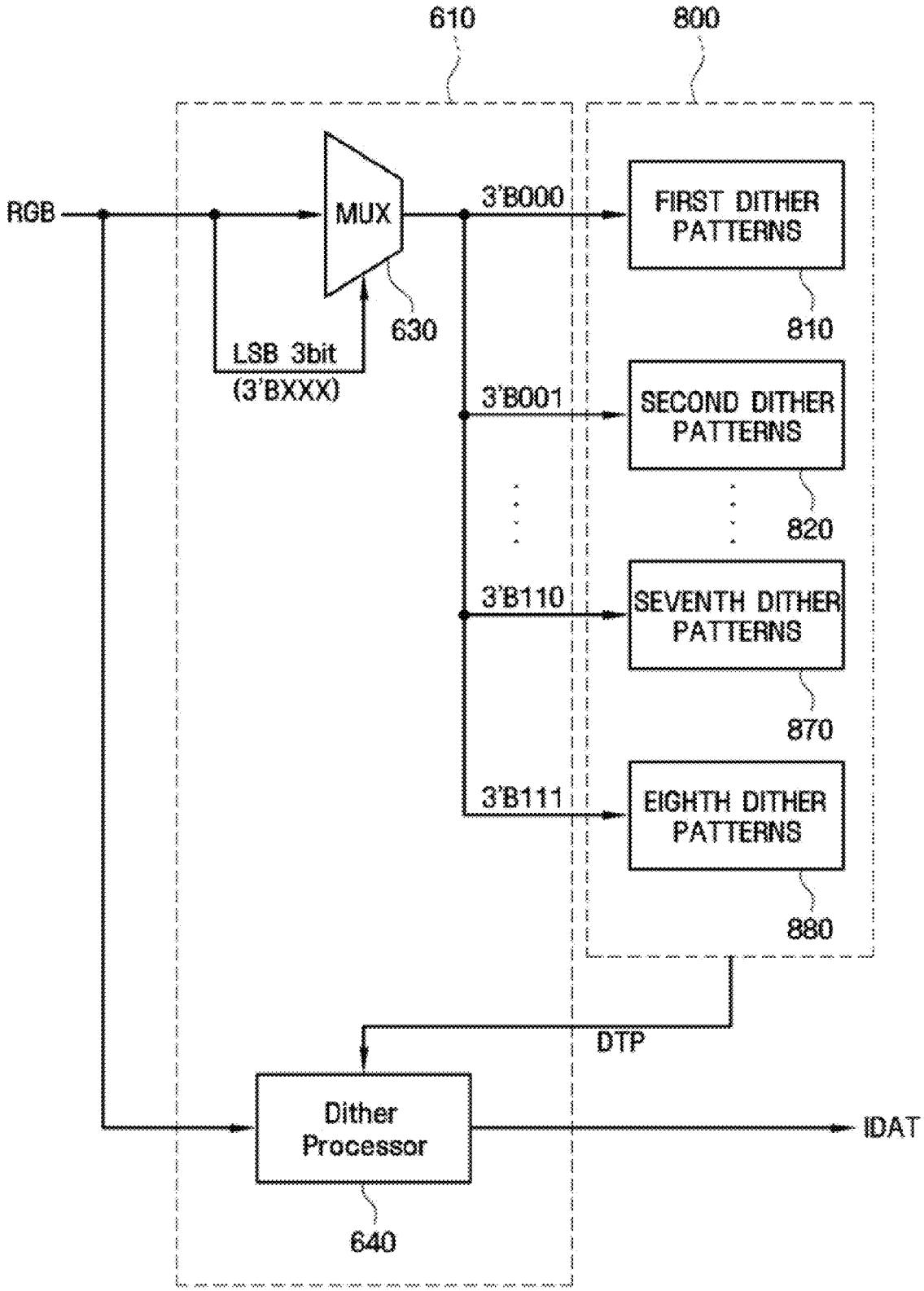
FIG. 4 is a block diagram for explaining a process in which an image signal controller of FIG. 3 reads dither patterns from a dither memory of FIG. 1.

FIG. 4 is a block diagram illustrating how the image signal controller 610 of FIG. 3 reads dither patterns from the dither memory 800 of FIG. 1.

Referring to FIG. 4, the image signal controller 610 may determine a dither level with reference to least significant bits (LSBs) of the original image signal RGB and read a series of dither patterns, which correspond to the determined dither level, from the dither memory 800. Here, the LSBs of the original image signal RGB denote the least significant digits thereof.

The image signal controller 610 may include a multiplexer 630 and a dither processor 640.

The multiplexer 630 may address a series of dither patterns corresponding to the determined dither level, which are included in a dither set, from the dither memory 800, which stores a plurality of dither sets, by using the LSBs of the original image signal RGB as a selection signal. FIG. 4 illustrates first through eighth dither patterns 810 through 880, each being a series of dither patterns, i.e., a dither set, which correspond to a dither level. In FIG. 4, the LSBs of the original image signal RGB are LSB 3 bits (least significant 3 bits).

For example, when the LSBs of the original image signal RGB are '000,' the first dither patterns 810 are read. When the LSBs of the original image signal RGB are '001,' the second dither patterns 820 are read. When the LSBs are '010,' the third dither patterns (not shown) are read. When the LSBs are '011,' the fourth dither patterns (not shown) are read. When the LSBs are '100,' the fifth dither patterns (not shown) are read. When the LSBs are '101,' the sixth dither patterns (not shown) are read. When the LSBs are '110,' the seventh dither patterns 870 are read. When the LSBs are '111,' the eighth dither patterns 880 are read.

The dither processor 640 receives dither patterns DTP, dithers the original image signal RGB by using the received dither patterns DTP, and outputs the dither image signal IDAT. Although the dither image signal IDAT has a smaller number of bits than the original image signal RGB, more gray levels can be expressed than when the dither image signal IDAT is used in comparison with the case when the dither patterns DTP are not applied. This dithering process will be described in more detail with reference to FIG. 5.

The dither memory 800 may store a series of dither patterns, which correspond to each dither level of the original image signal RGB, in the form of a LUT.

FIG. 5 is a table showing a dither set for each dither level. A case where the dither image signal IDAT includes image information contained in the LSBs of the original image signal RGB will be described in more detail with reference to FIG. 5. Referring to FIG. 5, when the LSBs of the original image signal RGB are 3 digits, $2^3$ dither levels may be expressed. LSB 3 bits '000,' '001,' '010,' '011,' '100,' '101,' '110,' and '111' may correspond to dither levels '0/8,' '1/8,' '2/8,' '3/8,' '4/8,' '5/8,' '6/8,' and '7/8,' respectively.

The number of dither pixels included in each dither block may be determined by a dither level. Here, dither pixels refer to pixels, which are to be dithered, from among a plurality of pixels included in each dither block. Pixels to be dithered may be driven by data that is obtained by adding one to data of upper bits which are bits of the original image signal RGB excluding the LSB 3 bits. That is, an image data voltage having a value, which corresponds to the data obtained by adding one to the data of the upper bits of the original image signal RGB, may be applied to pixels that are to be dithered. In addition, an image data voltage having a value, which corresponds to the data of the upper bits of the original image signal RGB, may be applied to pixels that are not to be dithered.

The number of dither pixels included in each dither block may be determined to be 0, 2, 4, 6, 8, 10, 12, and 14 according to the dither levels '0/8,' '1/8,' '2/8,' '3/8,' '4/8,' '5/8,' '6/8,' and '7/8,' respectively. Referring to each dither pattern shown in FIG. 5, pixels, which are to be dithered, from among pixels included in each dither block are indicated by oblique lines.

Specifically, when the LSB 3 bits of the original image signal RGB are '000,' 16 adjacent pixels may all be driven by an image data voltage which corresponds to the data of the upper bits of the original image signal RGB. When the LSB 3 bits of the original image signal RGB are '001,' two of the 16 adjacent pixels may be driven by an image data voltage which corresponds to the data obtained by adding one to the data of the upper bits of the original image signal RGB. Thus, the 16 pixels can display, on average, an image whose LSB 3 bits are '001.'

Likewise, four of the 16 adjacent pixels when the LSB 3 bits of the original image signal RGB are '010,' six of the 16 adjacent pixels when the LSB 3 bits of the original image signal RGB are '011,' eight of the 16 adjacent pixels when the LSB 3 bits of the original image signal RGB are '100,' ten of the 16 adjacent pixels when the LSB 3 bits of the original image signal RGB are '101,' twelve of the 16 adjacent pixels when the LSB 3 bits of the original image signal RGB are '110,' and fourteen of the 16 adjacent pixels when the LSB 3 bits of the original image signal RGB are '111' may be driven by the image data voltage which corresponds to the data obtained by adding one to the data of the upper bits of the original image signal RGB. Thus, the 16 pixels can display, on average, an image corresponding to each dither level.

A dither set corresponding to each dither level includes a series of dither patterns. An equal number of dither pixels are included in each of the series of dither patterns in each dither set. However, the locations of the dither pixels differ in each dither pattern. When a dither level is determined for a dither block, a series of dither patterns corresponding to the determined dither level are sequentially applied to successive frames of the dither block. In FIG. 5, eight or four dither patterns are sequentially applied to the $(8n)^{th}$ through $(8n+7)^{th}$ frames for each dither level. Since images are displayed by changing the locations of dither pixels every frame, display defects, such as flickering, can be reduced.

Figure 6A:
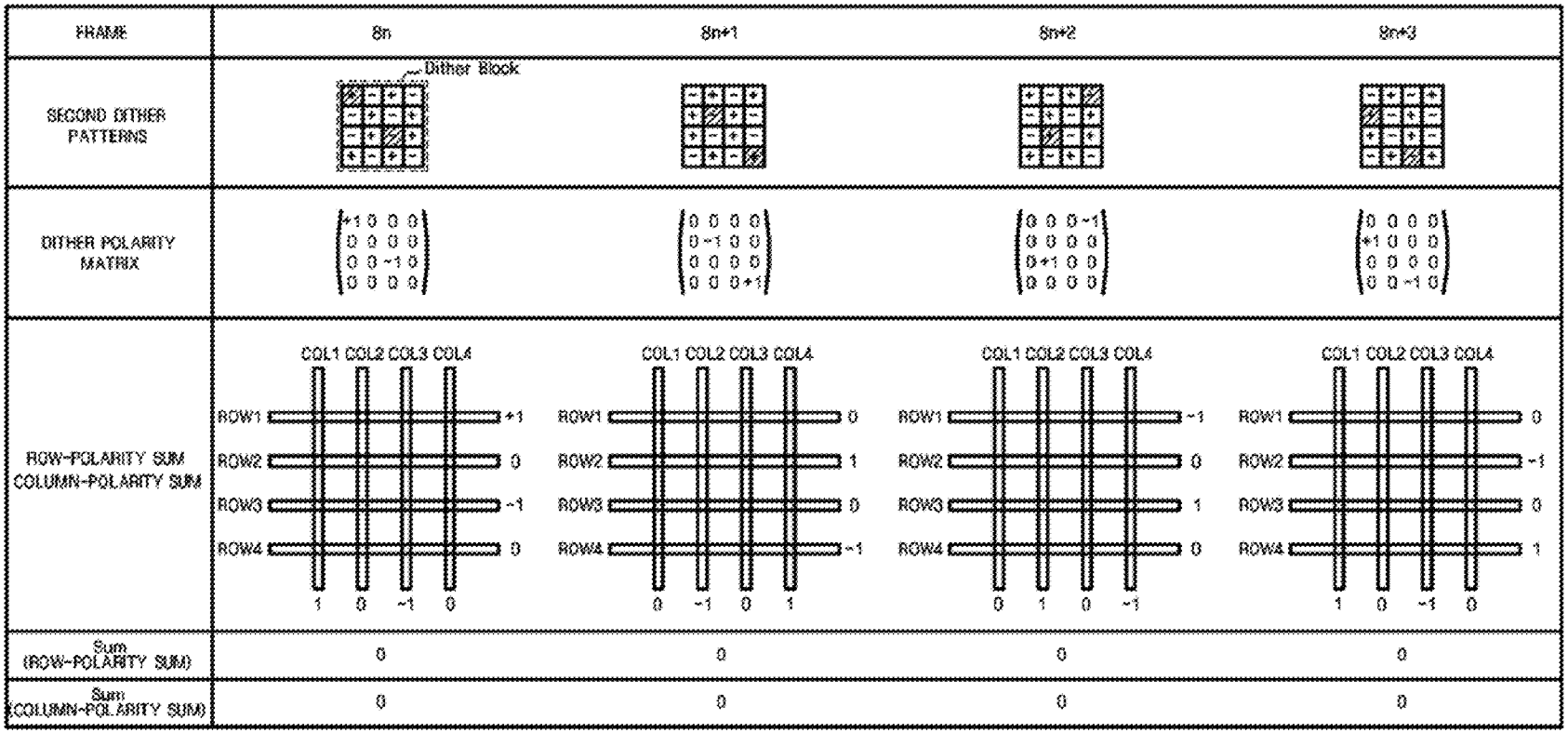
FIGS. 6A and 6B are tables for explaining the process of setting each dither pattern shown in FIG. 5, e.g., second dither patterns.
Figure 6B:
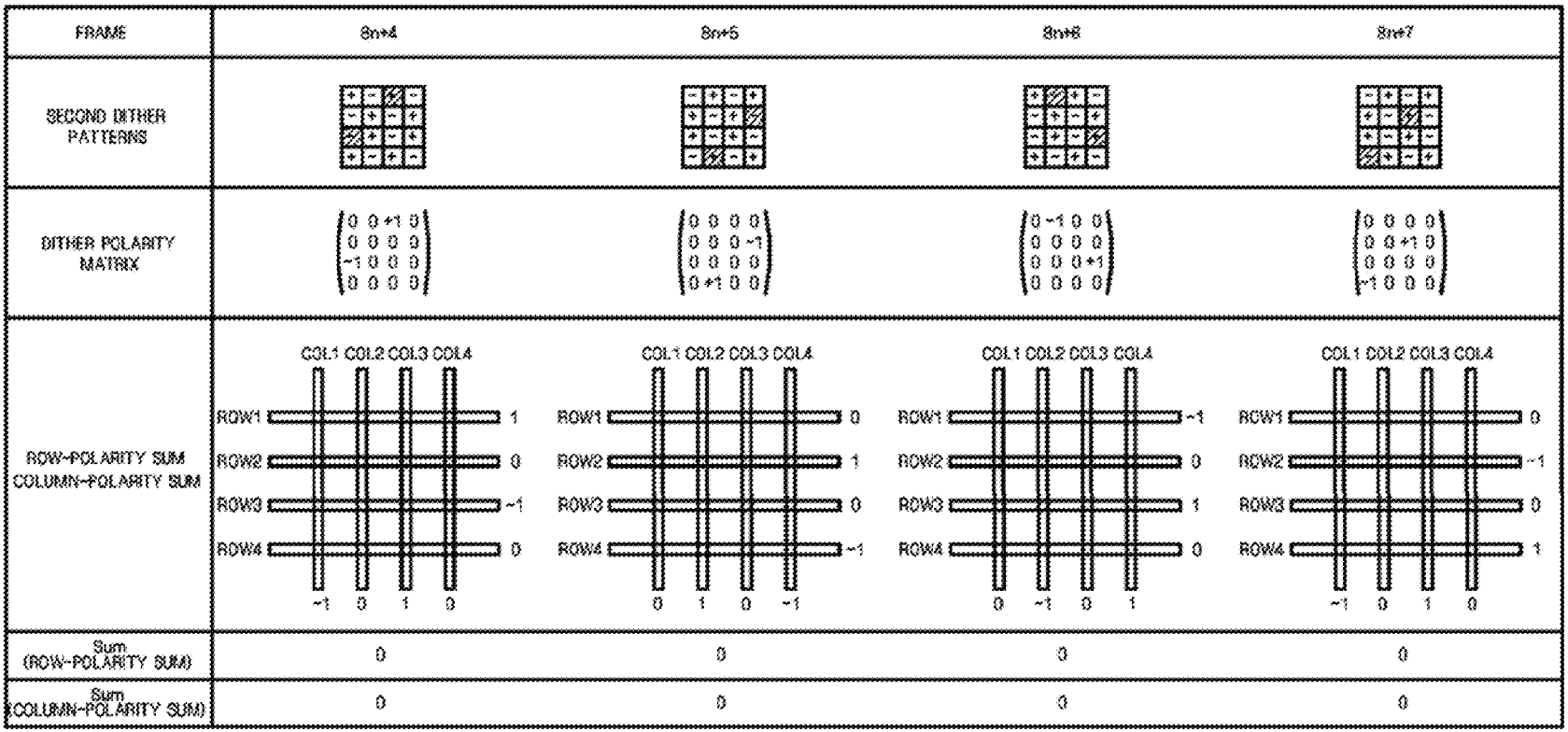

A process of assigning each dither pattern shown in FIG. 5 will now be described in more detail with reference to FIGS. 6A and 6B. FIGS. 6A and 6B are tables for explaining the process of assigning each dither pattern shown in FIG. 5, e.g., the second dither patterns. In FIGS. 6A and 6B, each dither block (i.e., each of the second dither patterns) includes a plurality of pixels arranged in a 4×4 matrix.

Referring to FIGS. 6A and 6B, the polarities of pixels included in each dither block may be inverted every frame and driven accordingly. In FIGS. 6A and 6B, sign '+/−' indicates that each pixel is driven in positive/negative polarity. It can be understood that the polarity of each pixel is inverted in each of the successive $(8n)^{th}$ through $(8n+7)^{th}$ frames and driven accordingly.

Each dither pattern may be assigned such that a corresponding dither block includes equal numbers of positive-polarity dither pixels and negative-polarity dither pixels. It can be understood from each dither pattern of FIGS. 6A and 6B that the number of dither pixels driven in positive polarity, i.e., positive-polarity dither pixels, is equal to that of dither pixels driven in negative polarity, i.e., negative-polarity dither pixels. In each dither pattern of FIGS. 6A and 6B applied to each of the $(8n)^{th}$ through $(8n+7)^{th}$ frames, the number of positive-polarity dither pixels and the number of negative-polarity dither pixels are one.

Each dither pattern may be assigned such that the sum of elements of a corresponding dither polarity matrix is zero. Each element of the dither polarity matrix corresponds to each pixel in a dither block. In addition, each element of the dither polarity matrix indicates whether a corresponding pixel in the dither block is a dither pixel that is to be dithered and indicates the polarity of the dither pixel. In each dither polarity matrix shown in FIGS. 6A and 6B, '0' indicates a pixel that is not to be dithered, '+1' indicates a positive-polarity dither pixel, and '−1' indicates a negative-polarity dither pixel. As shown in each dither polarity matrix of FIGS. 6A and 6B, each dither pattern may be set such that the sum of elements of a corresponding dither polarity matrix is zero.

In addition, each dither pattern may be assigned such that the sum of elements of a corresponding dither polarity matrix is zero and that at least one of the sum of row-polarity sums and the sum of column-polarity sums is zero. Each row-polarity sum is the sum of elements in each row of the dither polarity matrix, and each column-polarity sum is the sum of elements in each column of the dither polarity matrix.

For example, in a dither polarity matrix corresponding to a dither pattern that is applied to the $(8n)^{th}$ frame of FIG. 6A, the row-polarity sum of a first row is +1, the row-polarity sum of a second row is 0, the row-polarity sum of a third row is −1, and the row-polarity sum of a fourth row is 0. Accordingly, the sum of the row-polarity sums of the first through fourth rows is zero. In addition, the column-polarity sum of a first column is +1, the column-polarity sum of a second column is 0, the column-polarity sum of a third column is −1, and the column-polarity sum of a fourth column is 0. Accordingly, the sum of the column-polarity sums of the first through fourth columns is zero.

As described above, each dither pattern may be assigned such that at least one of the sum of row-polarity sums of a corresponding dither polarity matrix and the sum of column-polarity sums of the dither polarity matrix is zero. Although the process of setting a dither pattern that is applied to each of the $(8n+1)^{th}$ through $(8n+7)^{th}$ frames of FIGS. 6A and 6B is not described for simplicity, the above description of the process of setting the dither pattern that is applied to the $(8n)^{th}$ frame may also be applied to the $(8n+1)^{th}$ through $(8n+7)^{th}$ frames.

Each dither pattern may also be assigned such that the sum of elements of a corresponding dither polarity matrix is zero, that at least one of the sum of row-polarity sums of the dither polarity matrix and the sum of column-polarity sums of the dither polarity matrix is zero, and that each row-polarity sum and each column-polarity sum are zero, respectively. For example, referring to dither polarity matrices (not shown) corresponding to two of the fifth dither patterns of FIG. 5 which are applied to the $(8n+1)^{th}$ and $(8n+3)^{th}$ frames, respectively, each of the two fifth dither patterns is set such that each row-polarity sum and each column-polarity sum of a corresponding dither polarity matrix are zero, respectively.

Figure 7A:
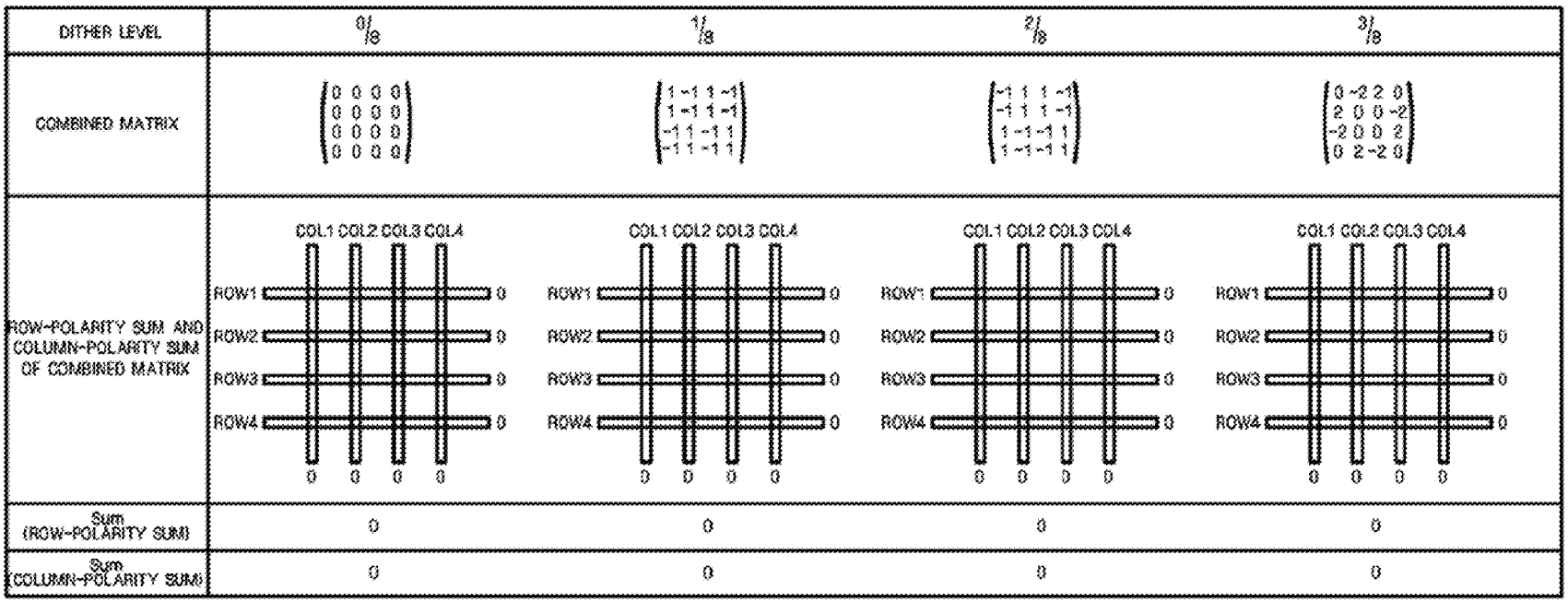
FIGS. 7A and 7B are tables for explaining the process of setting a series of dither patterns for each dither level shown in FIG. 5.
Figure 7B:
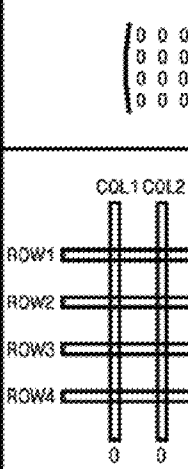
Figure 7B:
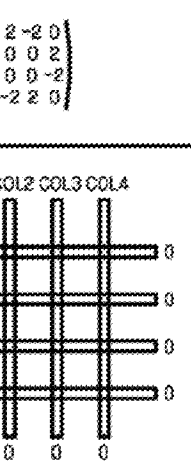
Figure 7B:
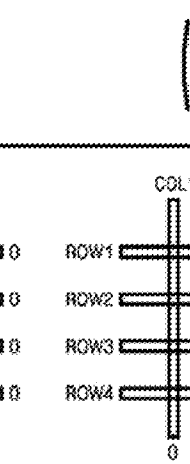
Figure 7B:
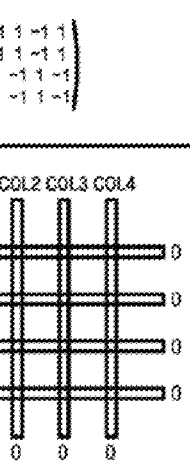

A process of assigning a series of dither patterns included in a dither set will now be described with reference to FIGS. 7A and 7B. FIGS. 7A and 7B are tables for explaining the process of assigning a series of dither patterns for each dither level shown in FIG. 5.

A series of dither patterns included in a dither set may be assigned by using a combined matrix which is obtained by adding respective dither polarity matrices of the dither patterns. FIGS. 7A and 7B illustrate a combined matrix corresponding to each dither level.

A series of dither patterns may be assigned such that at least one of the sum of row-polarity sums of a combined matrix and the sum of column-polarity sums of the combined matrix is zero. In this case, each row-polarity sum is the sum of elements in each row of the combined matrix, and each column-polarity sum is the sum of elements in each column of the combined matrix.

For example, in the case of the second dither patterns corresponding to the dither level '1/8' and described above with reference to FIGS. 6A and 6B, the row-polarity sum of a first row of a combined matrix is 0, the row-polarity sum of a second row is 0, the row-polarity sum of a third row is 0, and the row-polarity sum of a fourth row is 0. Accordingly, the sum of the row-polarity sums of the first through fourth rows is zero. In addition, the column-polarity sum of a first column of the combined matrix is 0, the column-polarity sum of a second column is 0, the column-polarity sum of a third column is 0, and the column-polarity sum of a fourth column is 0. Accordingly, the sum of the column-polarity sums of the first through fourth columns is zero.

As described above, a series of dither patterns may be assigned such that at least one of the sum of row-polarity sums of a combined matrix and the sum of column-polarity sums of the combined matrix is zero. The above description may also be applied to the first dither patterns corresponding to the dither level '0/8' and the third through eighth dither patterns corresponding to the dither levels '2/8' through '7/8,' respectively.

A series of dither patterns may also be assigned such that each row-polarity sum of a combined matrix and each column-polarity sum of the combined matrix are zero, respectively. For example, referring to the combined matrices of FIGS. 7A and 7B which correspond to the dither levels '0/8' through '7/8,' respectively, a series of dither patterns are set such that each row-polarity sum and each column-polarity sum of a corresponding combined matrix are zero, respectively.

Figure 8:
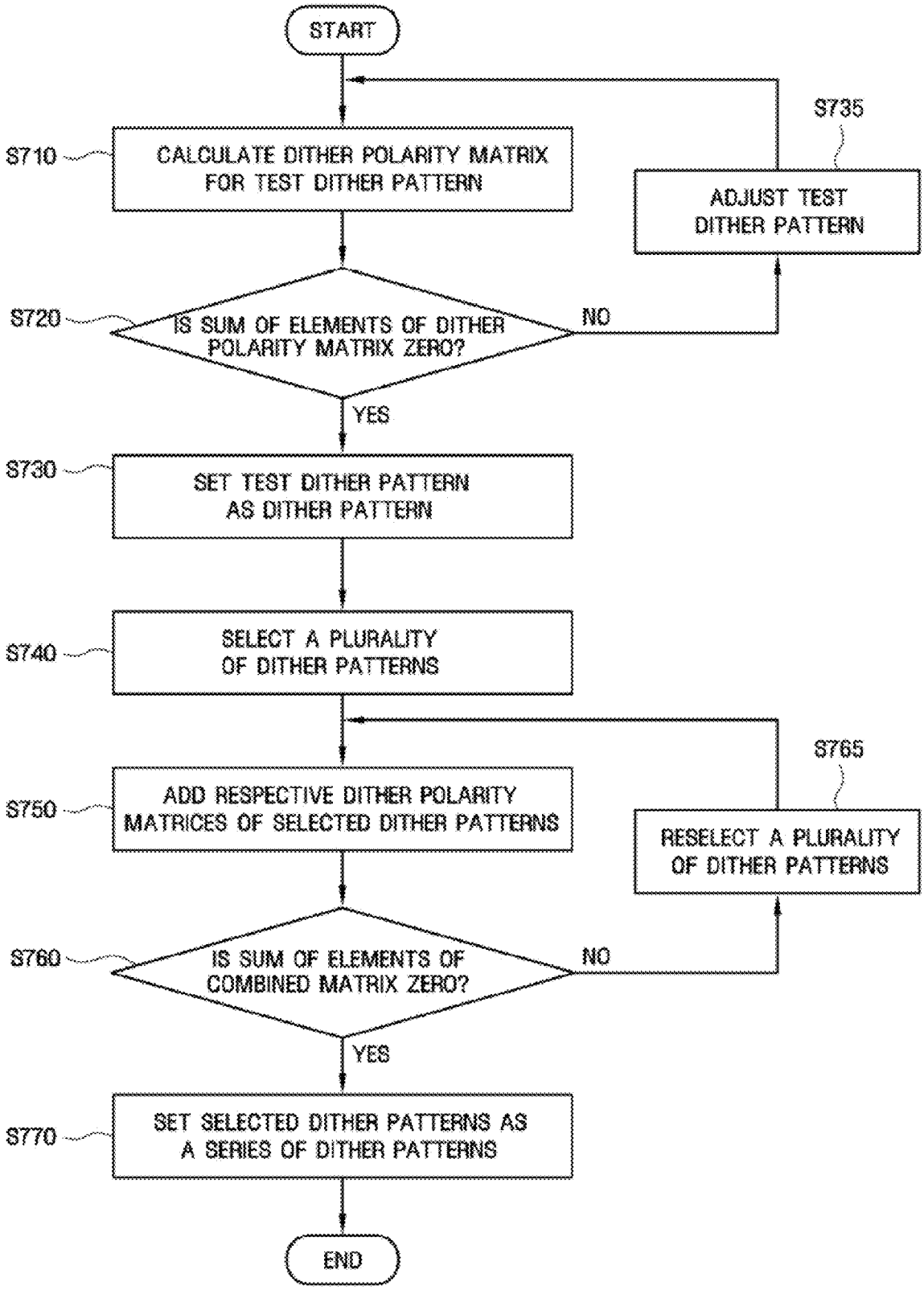
FIG. 8 is a flowchart illustrating a method of driving a display device according to an exemplary embodiment of the present invention.

Hereinafter, a process of assigning each dither pattern and the process of assigning a series of dither patterns in a method of driving a display device according to an exemplary embodiment of the present invention will be described with reference to FIG. 8. FIG. 8 is a flowchart illustrating a method of driving a display device according to an exemplary embodiment of the present invention. First of all, a process of assigning each dither pattern will now be described.

A dither polarity matrix for a test dither pattern is calculated (operation S710). Then, it is determined whether the sum of elements of the dither polarity matrix for the test dither pattern is zero (operation S720).

When it is determined that the sum of elements of the dither polarity matrix for the test dither pattern is zero, the test dither pattern is set as a dither pattern (operation S730). Here, the test dither pattern may be assigned as a dither pattern when the sum of elements of the dither polarity matrix for the test dither pattern is zero and when at least one of the sum of row-polarity sums of the dither polarity matrix and the sum of column-polarity sums of the dither polarity matrix is zero.

In addition, the test dither pattern may be assigned as a dither pattern when each row-polarity sum and each column-polarity sum of the dither polarity matrix are zero, respectively.

When it is determined that the sum of elements of the dither polarity matrix for the test dither pattern is not zero, the test dither pattern is adjusted (operation S725).

Next, a process of assigning a series of dither patterns in the method of driving a display device according to the exemplary embodiment will be described.

A plurality of dither patterns, in each of which a corresponding dither block includes equal numbers of positive-polarity dither pixels and negative-polarity dither pixels, may be selected, and the selected dither patterns may be assigned as a series of dither patterns.

Specifically, operations S710 through S730 are repeated a number of times to set a plurality of dither patterns for each dither level. Then, a plurality of dither patterns are selected from the dither patterns set for each dither level (operation S740).

A combined matrix which is the sum of respective dither polarity matrices of the selected dither patterns is calculated (operation S750). Next, it is determined whether the sum of elements of the combined matrix is zero (operation S760).

When it is determined that the sum of elements of the combined matrix is zero, the selected dither patterns are assigned as a series of dither patterns for each dither level (operation S760). Here, the selected dither patterns may be assigned as a series of dither patterns corresponding to each dither level when the sum of elements of the combined matrix is zero and when at least one of the sum of row-polarity sums of the combined matrix and the sum of column-polarity sums of the combined matrix is zero.

In addition, the selected dither patterns may be assigned as a series of dither patterns for each dither level when each row-polarity sum and each column-polarity sum of the combined matrix are zero, respectively. In this way, a series of dither patterns may be assigned by using a combined matrix which is the sum of the respective dither polarity matrices of the selected dither patterns.

As described above, in a display device and a method of driving the same according to an exemplary embodiment of the present invention, a dither pattern is assigned in consideration of the polarities of dither pixels. That is, the polarities of dither pixels are taken into consideration by using a dither polarity matrix to assign each dither pattern and using a combined matrix to assign a series of dither patterns for each dither level. In addition, each dither pattern is assigned such that a corresponding dither block includes equal numbers of positive-polarity dither pixels and negative-polarity dither pixels, thereby improving the display quality of the display device.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A display device comprising:

a display panel which comprises a plurality of dither blocks displaying an image that corresponds to a dither image signal; and an image signal controller which generates the dither image signal by using a dither pattern that determines a plurality of dither pixels, which are to be dithered, from among a plurality of pixels included in each of the dither blocks, wherein each of the dither blocks comprises a plurality of pixels, whose respective polarities are inverted at least every one frame and which are driven accordingly, and comprises equal numbers of positive-polarity dither pixels and negative-polarity dither pixels, and wherein a dither polarity matrix is associated with each dither block, a number of dither pixels included in each of the dither blocks is determined by a dither level, a dither set comprising a series of dither patterns for the dither level is assigned using a combined matrix for the dither level which is a sum of the respective dither polarity matrices of the series of dither patterns for said level.

2. The display device of claim 1, wherein each element of the dither polarity matrix corresponds to a pixel in each of the dither blocks, indicates whether each pixel is a dither pixel that is to be dithered and a polarity of the dither pixel, wherein the dither pattern is assigned such that a sum of elements of the dither polarity matrix is zero.

3. The display device of claim 2, wherein a row-polarity sum is a sum of elements in each row of the dither polarity matrix, and a column-polarity sum is a sum of elements in each column of the dither polarity matrix, wherein the dither pattern is set such that at least one of the sum of the row-polarity sums of the dither polarity matrix and the sum of the column-polarity sums of the dither polarity matrix is zero.

4. The display device of claim 3, wherein the dither pattern is set such that each row-polarity sum of the dither polarity matrix and each column-polarity sum of the dither polarity matrix are zero, respectively.

5. The display device of claim 2, wherein the series of dither patterns are assigned such that at least one of the sum of row-polarity sums of the combined matrix and the sum of column-polarity sums of the combined matrix is zero, wherein each row-polarity sum is the sum of elements in each row of the combined matrix, and each column-polarity sum is the sum of elements in each column of the combined matrix.

6. The display device of claim 5, wherein the series of dither patterns are assigned such that each row-polarity sum of the combined matrix and each column-polarity sum of the combined matrix are zero, respectively.

7. The display device of claim 1, further comprising a data driver which receives the dither image signal and outputs an image data voltage, wherein the image signal controller receives an original image signal having a first number of bits, the image data voltage has a second number of bits which is less than the first number of bits, and the dither level is determined by least significant bits (LSBs) of the original image signal.

8. The display device of claim 7, wherein the series of dither patterns assigned for the determined dither level are sequentially applied to successive frames.

9. A method of driving a display device, the method comprising:

assigning a dither pattern which determines a plurality of dither pixels, which are to be dithered, from among a plurality of pixels included in a dither block;

generating a dither image signal by applying the dither pattern to an original image signal; and displaying an image corresponding to the dither image signal, wherein the dither pattern is assigned such that each dither block comprises equal numbers of positive-polarity dither pixels and negative-polarity dither pixels, and wherein a dither polarity matrix is associated with each dither block, a number of dither pixels included in each dither block is determined by a dither level, and a dither set, which comprises a series of dither patterns for the dither level, is assigned by using a combined matrix for the dither level obtained by adding respective dither polarity matrices of the series of dither patterns for said level.

10. The method of claim 9, wherein each element of the dither polarity matrix corresponds to a pixel in an associated dither block, indicates whether each pixel is a dither pixel that is to be dithered and a polarity of the dither pixel, wherein assigning the dither pattern comprises:

calculating the dither polarity matrix for a test dither pattern; and assigning the test dither pattern as the dither pattern when the sum of elements of the dither polarity matrix is zero.

11. The method of claim 10, wherein a row-polarity sum is a sum of elements in each row of the dither polarity matrix, and a column-polarity sum is a sum of elements in each column of the dither polarity matrix, wherein assigning the dither pattern comprises:

calculating the dither polarity matrix for the test dither pattern; and assigning the test dither pattern as the dither pattern when at least one of the sum of the row-polarity sums of the dither polarity matrix and the sum of the column-polarity sums of the dither polarity matrix is zero.

12. The method of claim 11, wherein assigning the dither pattern comprises:

calculating the dither polarity matrix for the test dither pattern; and assigning the test dither pattern as the dither pattern when each row-polarity sum of the dither polarity matrix and each column-polarity sum of the dither polarity matrix are zero, respectively.

13. The method of claim 9, wherein assigning the dither set comprises:

selecting a plurality of dither patterns in each of which a corresponding dither block comprises equal numbers of positive-polarity dither pixels and negative-polarity dither pixels; and assigning the selected dither patterns as the series of dither patterns.

14. The method of claim 10, wherein assigning the selected dither patterns as the series of dither patterns comprises assigning the selected dither patterns as the series of dither patterns when at least one of the sum of row-polarity sums of the combined matrix and the sum of column-polarity sums of the combined matrix is zero, wherein each row-polarity sum is the sum of elements in each row of the combined matrix, and each column-polarity sum is the sum of elements in each column of the combined matrix.

15. The method of claim 14, wherein assigning the selected dither patterns as the series of dither patterns comprises assigning the selected dither patterns as the series of dither patterns when each row-polarity sum of the combined matrix and each column-polarity sum of the combined matrix are zero, respectively.

16. The method of claim 13, wherein generating the dither image signal comprises:

determining the dither level with reference to least significant bits of the original image signal; and generating the dither image signal by applying the series of dither patterns, which correspond to the dither level, to the original image signal.

17. The method of claim 16, wherein the original image signal has a first number of bits, and displaying the image corresponding to the dither image signal comprises:

receiving the dither image signal;

outputting an image data voltage having a second number of bits which is less than the first number of bits; and displaying the image.

* * * * *